US011364525B2

(12) United States Patent
Yang

(10) Patent No.: US 11,364,525 B2
(45) Date of Patent: Jun. 21, 2022

(54) ROLL CHANGING DEVICE AND WORK ROLL CHANGING METHOD BASED ON ROLL CHANGING DEVICE

(71) Applicant: WISDRI ENGINEERING & RESEARCH INCORPORATION LIMITED, Hubei (CN)

(72) Inventor: Wei Yang, Hubei (CN)

(73) Assignee: WISDRI ENGINEERING & RESEARCH INCORPORATION LIMITED, Hubei (CN)

( * ) Notice: Subject to any disclaimer, the term of this patent is extended or adjusted under 35 U.S.C. 154(b) by 29 days.

(21) Appl. No.: 16/767,595

(22) PCT Filed: Sep. 19, 2018

(86) PCT No.: PCT/CN2018/106382
§ 371 (c)(1),
(2) Date: Nov. 11, 2020

(87) PCT Pub. No.: WO2019/105112
PCT Pub. Date: Jun. 6, 2019

(65) Prior Publication Data

US 2021/0107046 A1 Apr. 15, 2021

(30) Foreign Application Priority Data

Nov. 28, 2017 (CN) ..... 201711212562.2

(51) Int. Cl.
*B21B 31/10* (2006.01)

(52) U.S. Cl.
CPC ..... *B21B 31/103* (2013.01)

(58) Field of Classification Search
CPC ..... B21B 31/103; B21B 31/00; B21B 31/08; B21B 31/10
(Continued)

(56) References Cited

U.S. PATENT DOCUMENTS 3,180,125 A * 4/1965 O'Brien ..... B21B 31/103 72/239
9,511,400 B2 * 12/2016 Charre ..... B21B 31/00

FOREIGN PATENT DOCUMENTS

CN 202097190 1/2012
CN 103237608 8/2013
(Continued)

OTHER PUBLICATIONS

Translation of CN-204503769-U (Year: 2015).*
(Continued)

*Primary Examiner* — Shelley M Self
*Assistant Examiner* — Teresa A Guthrie
(74) *Attorney, Agent, or Firm* — JCIP Global Inc.

(57) ABSTRACT

A roll changing device is applicable to a multi-roll mill. Under a roll changing state, assembly parts of the work rolls and the bearing chocks have a lateral movement space with the internal width not less than the assembly width of the work rolls and the bearing chocks in a lateral direction of the assembly parts moving along a rolling strip in a mill house, and the movement space allows another work rolls to coexist with used work rolls in the mill house before the used work rolls are pulled out. The roll changing device is provided with at least two rows of clamping heads, one row of clamping heads corresponding to an inlet side are inlet clamping heads, another row of clamping heads close to an outlet side are outlet clamping heads, each row of clamping heads comprises a pair of upper and lower clamping heads arranged in parallel.

4 Claims, 7 Drawing Sheets

(58) Field of Classification Search
USPC ..... 72/237, 238, 239
See application file for complete search history.

(56) References Cited

FOREIGN PATENT DOCUMENTS

| | | | |
|---|---|---|---|
| CN | 203862691 | | 10/2014 |
| CN | 204503769 | | 7/2015 |
| CN | 204503769 U | * | 7/2015 |
| CN | 105290761 | | 2/2016 |
| CN | 106424148 | | 2/2017 |
| CN | 107931335 | | 4/2018 |
| CN | 207872731 | | 9/2018 |
| KR | 20160139698 | | 12/2016 |

OTHER PUBLICATIONS

"International Search Report (Form PCT/ISA/210)" of PCT/CN2018/106382, dated Dec. 20, 2018, with English translation thereof, pp. 1-6.

* cited by examiner

ROLL CHANGING DEVICE AND WORK ROLL CHANGING METHOD BASED ON ROLL CHANGING DEVICE

CROSS-REFERENCE TO RELATED APPLICATION

This application is a 371 of international application of PCT application serial no. PCT/CN2018/106382, filed on Sep. 19, 2018, which claims the priority benefit of China application no. 201711212562.2, filed on Nov. 28, 2017. The entirety of each of the above mentioned patent applications is hereby incorporated by reference herein and made a part of this specification.

BACKGROUND

Technical Field

The present invention belongs to the technical field of a multi-roll mill, and particularly relates to an efficient roll changing structure and method for a multi-roll cold rolling strip mill.

Description of Related Art

In the field of cold rolling metal strips, different from mills with a relatively small number of rolls such as 2 rolls, 4 rolls and 6 rolls, a mill with more than 6 to 8 rolls is generally called a multi-roll mill, such as a 36-roll mill, a 20-roll mill, a 18-roll mill, a 12-roll mill or a 10-roll mill. A multi-roll mill is mostly used for rolling special metals with thin thickness and high strength, has the advantages of good thickness accuracy, excellent strip shape controlling ability and the like, and is widely used in metal rolling industry.

One of the typical features of such mills is that the diameter of a work roll is generally designed to be small, the work roll is not provided with a bearing chock and is clamped and fixed in a mill house through other roll bodies. When the work roll needs to be changed, a clamping mechanism of a roll changing device is generally used for clamping at least one end of a work roll body, so as to pull out a used roll from the mill house and mount a new roll in.

An existing widely used work roll changing method of a multi-roll mill specifically comprises the following process.

(1) The mill switches to a roll changing state, a roll gap is opened, and work roll brackets hold up work rolls.

(2) A roll changing device whose clamping mechanism is not loaded with new rolls enters a mill house of the mill.

(3) After the roll changing device is in position in an axial direction, the clamping mechanism exactly clamps used work rolls.

(4) The work roll brackets return to a standby position, and the roll changing device pulls the used work rolls out of the mill house.

(5) The roll changing device whose clamping mechanism clamps new work rolls enters the mill house.

(6) After the roll changing device pushing the new work rolls into the mill house is in position in the axial direction, the work roll brackets hold up the work rolls, and the clamping mechanism unclamps the work rolls.

(7) The roll changing device exits from the mill house.

(8) After the rolls changing is finished, the mill switches to a rolling state.

The roll changing process is similar to general roll changing methods of a 4-roll mill and a 6-roll mill, the basic schematic diagrams of the structure and the process of the roll changing device are generally shown in a rolling state diagram, a work roll changing preparation state diagram, a work roll changing state diagram (a roll changing device is outside a mill house) and a work roll changing state diagram (a roll changing device is in a mill house), as shown in FIGS. 1-4, which all adopt a process of "empty carriage entry, used roll exit, new roll pushing in and empty carriage exit", and the roll changing device needs to enter and exit from the mill house twice, consuming much time.

SUMMARY

The technical problem to be solved by the present invention is to overcome the defect of low roll changing efficiency of existing multi-roll mills, and the present invention provides a roll changing device which is simple in structure and convenient to operate, and can clamp work rolls conveniently; and meanwhile, the present invention provides an efficient work roll changing method for a multi-roll mill, work rolls can be changed with the roll changing device entering and exiting a mill house of the mill only once, and thus the roll changing efficiency is significantly improved.

To solve the above technical problem, the following technical solutions are adopted.

A roll changing device is adapted for a multi-roll mill. Work rolls of the multi-roll mill are not provided with bearing chocks, or the work rolls are provided with bearing chocks, but assembly parts of the work rolls and the bearing chocks have a lateral movement space with an internal width no less than an assembly width of the work rolls and the bearing chocks in a lateral direction of the assembly parts moving along a rolling strip in a mill house in a roll changing state, and the lateral movement space allows another group of work rolls to coexist with the work rolls in the mill house before the work rolls are pulled out of the mill house. The roll changing device is provided with at least two rows of clamping heads, one row of clamping heads corresponding to an inlet side of the rolling strip are configured as inlet clamping heads, another row of clamping heads close to an outlet side of the rolling strip are configured as outlet clamping heads, each row of clamping heads comprises a pair of upper and lower clamping heads which are arranged in parallel.

Further, the clamping heads comprise bottom bracket grooves, and clampers capable of applying an acting force to a direction of the bracket grooves for clamping the work rolls tightly are arranged on upper portions of the bracket grooves at intervals.

Further, the clamping heads of the roll changing device are connected to clamping driving ends.

A work roll changing method adopting the above roll changing device. Through cooperation of the roll changing device and work roll brackets, work rolls are changed with the roll changing device entering and exiting from a mill house of a mill only once, and the method comprises the following steps.

(1) The mill switches to a roll changing state, a roll gap is opened, and work roll brackets at an inlet side of the mill hold up a pair of used work rolls to be changed, and meanwhile, the pair of used work rolls are laterally moved to the inlet side of the mill.

(2) The roll changing device enters the mill house, outlet clamping heads of the roll changing device load a pair of new work rolls, and inlet clamping heads are in an empty carriage state.

(3) The roll changing device enters the mill house along an axial direction of the work rolls, and the new work rolls loaded by the outlet clamping heads are in position exactly in an axial direction during the process.

(4) Work roll brackets at an outlet side of the mill hold up the new work rolls.

(5) The inlet clamping heads of the roll changing device clamp the pair of used work rolls close to the inlet side.

(6) The work roll brackets at the inlet side retract to a rolling state, and the pair of used work rolls at the inlet side are fixed only by the inlet clamping heads of the roll changing device at the moment, and meanwhile, the work roll brackets at the outlet side hold up the pair of new work rolls just pushed in from the outlet side.

(7) The outlet clamping heads of the roll changing device unclamp the pair of new work rolls located at the outlet side, and the new work rolls are only held up by the work roll brackets at the outlet side at the moment.

(8) The roll changing device exits from the mill house, with the inlet clamping heads loading the pair of used work rolls, and the outlet clamping heads being in the empty carriage state.

(9) The mill then switches to the rolling state, the roll gap is closed, the work roll brackets at the outlet side retract to the rolling state, and roll changing is completed.

In the above technical solutions, when the work rolls are changed in the above steps (1)-(9), the operations on the outlet side and the inlet side are performed in a reversed order, that is, the used rolls are moved toward the outlet side, the new rolls enter from the inlet side, and the used rolls and the new rolls are staggered in the mill house.

In the above technical solutions, each row of the clamping heads can only clamp a single work roll, that is, the single work roll can be changed.

In the above technical solutions, before the new work rolls enter the mill house to be in position and the used work rolls are pulled out of the mill house, the new work rolls and the used work rolls coexist in the mill house, and the new work rolls and the used work rolls are not in contact.

In the above technical solutions, the roll changing device loads the new work rolls needing to be changed before entering the mill house for roll changing.

Therefore, the work roll changing process of the present invention is "pushing new rolls in-pulling used rolls out", and the main process of roll changing can be completed with the roll changing device entering and exiting from the mill house only once.

The roll changing device is provided with at least two groups of fixing devices (namely the aforementioned clamping heads) for establishing a force relationship with the work rolls. Each group of fixing devices can hold at least one work roll, and the two groups of fixing devices can be independently switched between a work roll clamping state and a work roll unclamping state so as to independently switch the fixing relationship with the new work rolls and the used work rolls, and therefore, the new work rolls are unclamped while the used work rolls are fixed after the new rolls are in position, and finally the roll changing can be completed after the device enters and exits from the mill house only once.

The work roll changing method mentioned in the present invention utilizes a typical feature that the work rolls of such multi-roll mills are not provided with the bearing chocks and have a certain lateral movement space in the mill house, and the two working processes of "pushing new rolls in-pulling used rolls out" are provided. Through the lateral movement space of the work rolls in the mill house, the used work rolls move laterally (along an inlet or outlet direction of a rolling strip) for a distance when the mill switches to a roll changing state, thus an appropriate space is reserved for the new work rolls entering the mill house, and the new work rolls and the used work rolls can be placed in the mill house side by side. An 18-roll mill is taken as an example for describing a typical efficient work roll changing implementation. A similar roll changing method can also be adopted for efficient roll changing by other mills such as a 20-roll mill and a 36-roll mill.

According to the work roll changing method, before the used work rolls in the mill house are pulled out, the new work rolls have been pushed into the mill house. As a result, the roll changing process of "empty carriage entry-used roll exit-new roll pushing in-empty carriage exit" for work roll changing of a conventional cold-rolling mill is simplified into two working processes of "pushing new rolls in-pulling used rolls out", and thus the work roll changing efficiency can be effectively improved.

Compared with traditional roll changing methods, the work roll changing method of the present invention has the advantages that operation times of the roll changing device are reduced, the roll changing time can be shortened by 30-60%, especially for wide strip steel mills with the longer movement distance of the roll changing device entering and exiting from the mill house, the roll changing time is significantly shortened by using the method of the present invention, and the operability of the mill is improved.

DESCRIPTION OF THE EMBODIMENTS

Figure 5:
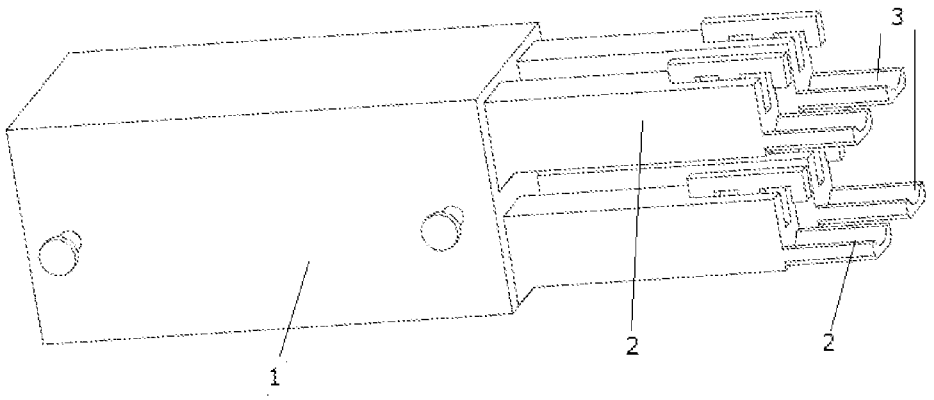
FIG. 5 is a roll changing device implemented according to the present invention.
Figure 6:
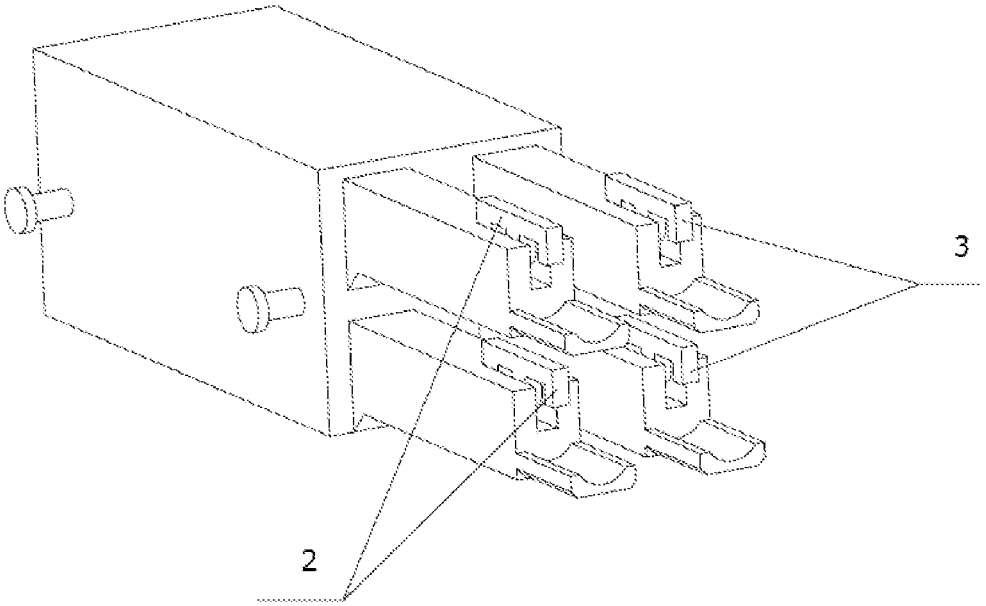
FIG. 6 is another stereoscopic diagram of FIG. 5.
Figure 7:
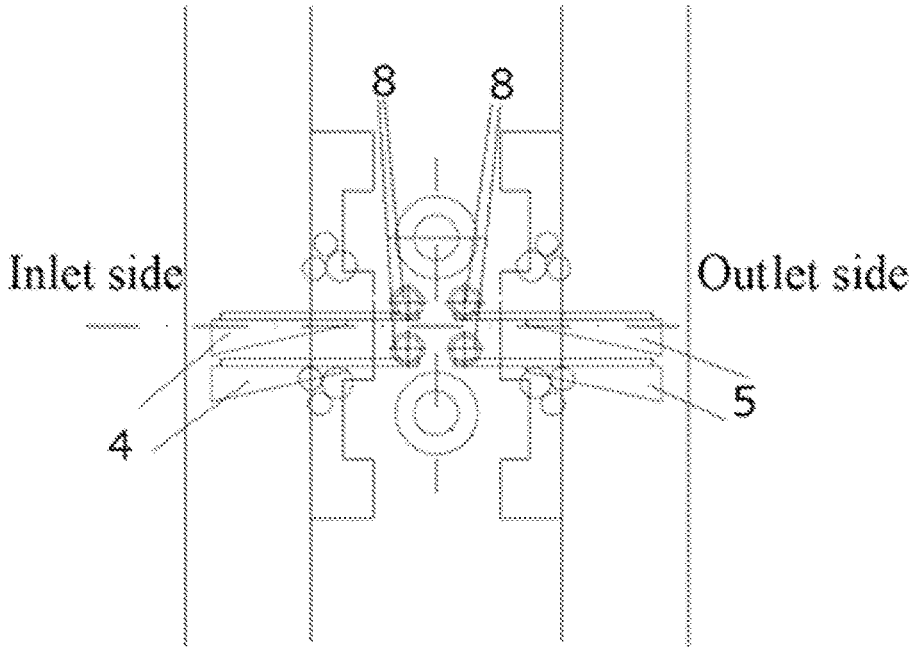
FIG. 7 is a diagram of a mill switched from a rolling state to a work roll changing preparation state according to an efficient work roll changing method of the present invention.

A roll changing device according to the present invention shown in FIG. 5 and FIG. 6 is applicable to a multi-roll mill and is characterized in that the multi-roll mill is not provided with bearing chocks, or work rolls are provided with bearing chocks. In a roll changing state, assembly parts of the work rolls and the bearing chocks have a lateral movement space with an internal width no less than an assembly width of the work rolls and the bearing chocks in a lateral direction of the assembly parts moving along a rolled strip in a mill house, and the lateral movement space allows another group of work rolls to coexist with used work rolls in the mill house before the used work rolls are pulled out of the mill house. The roll changing device 1 shown in FIG. 5 and FIG. 6 is provided with two rows of clamping heads (inlet clamping heads 3 and outlet clamping heads 2) corresponding to an inlet and an outlet of the rolling strip, the inlet clamping heads 3 and the outlet clamping heads 2 each comprise a pair of upper and lower clamping heads, and the four clamping heads are arranged in parallel.

Further, the inlet clamping heads 3 and the outlet clamping heads 2 comprise bottom bracket grooves, and clampers capable of applying an acting force to the bracket grooves for clamping the work rolls tightly are arranged on upper portions of the bracket grooves at intervals. The bracket grooves are not limited to the shape in which the bearing bush-shaped internal arc in the figures matches the work rolls, and also may be in shapes in which the work rolls can be clamped, such as a v shape.

Further, the inlet clamping heads 3 and the outlet clamping heads 2 are connected to clamping driving ends of head ends.

According an efficient work roll changing work roll method according to the present invention shown in FIGS. 7-11, an 18-roll mill is taken as an example for describing a typical efficient work roll changing implementation. A similar roll changing method may also be adopted for efficient roll changing by other mills such as a 20-roll mill and a 36-roll mill.

The present invention utilizes the typical feature that the work rolls of such multi-roll mills are not provided with bearing chocks and have a certain lateral movement space in the mill house, and two working processes of "pushing new rolls in and pulling used rolls out" are provided. Through the lateral movement space of the work rolls moving along the rolled strip in the mill house, the used work rolls move laterally (along an inlet or outlet direction of the rolling strip) when the mill switches to a roll changing state, thus an appropriate space is reserved for the new work rolls entering the mill house at first, and the new work rolls and the used work rolls can be placed in the mill house side by side, and details are as follows.

(1) A mill switches to a roll changing state (shown in FIG. 7), a roll gap is opened, work roll brackets at an inlet side hold up a pair of used work rolls 8 needing to be changed (or a single work roll, a pair of work rolls taken as an example herein), and meanwhile laterally move toward the inlet side of the mill.

Figure 8:
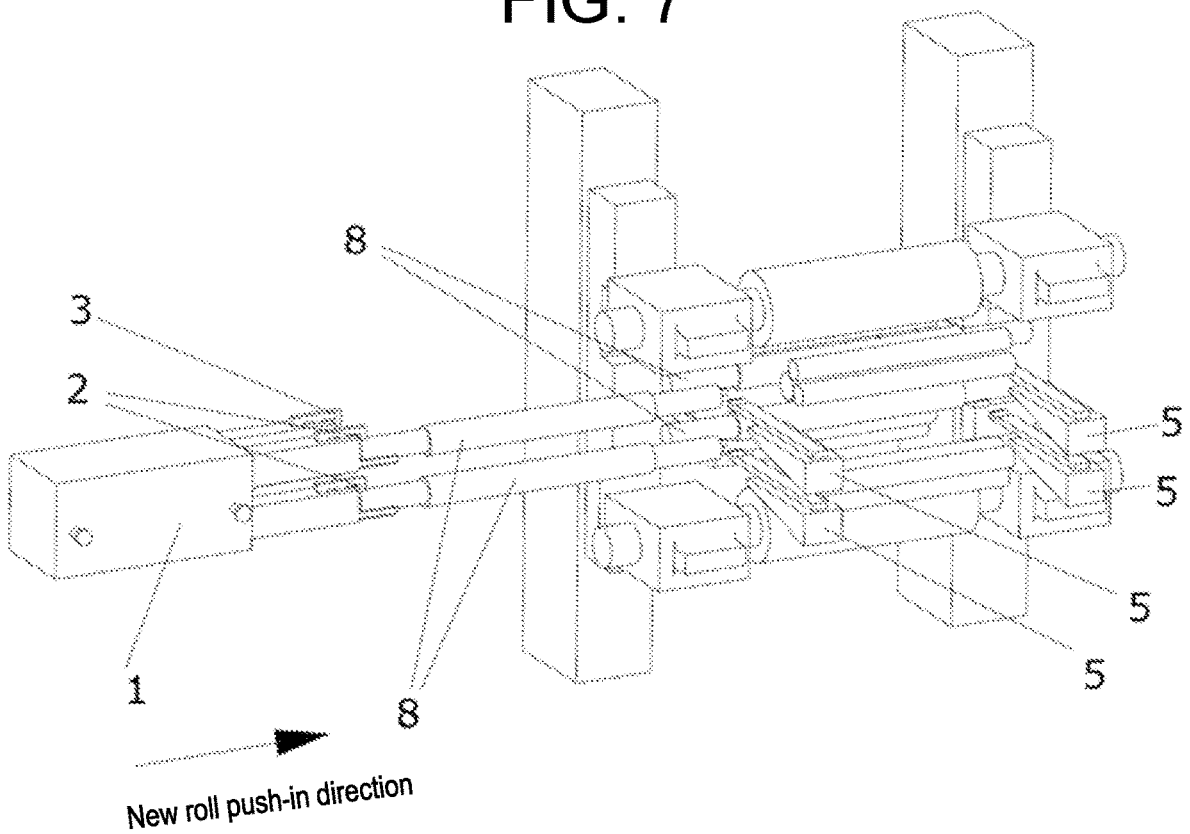
FIG. 8 is a state diagram of changing of work rolls of a mill implemented according to an efficient work roll changing method of the present invention (a roll changing device is outside a mill house when new rolls are pushed in)

(2) As shown in FIG. 8, a roll changing device 1 enters a mill house of the mill, outlet clamping heads 2 of the roll changing device load a pair of new work rolls 8, and inlet clamping heads 3 are in an empty carriage state.

(3) The roll changing device 1 enters the mill house, and the new work rolls 8 loaded by the outlet clamping heads 2 are in position exactly in an axial direction during the process.

Figure 9:
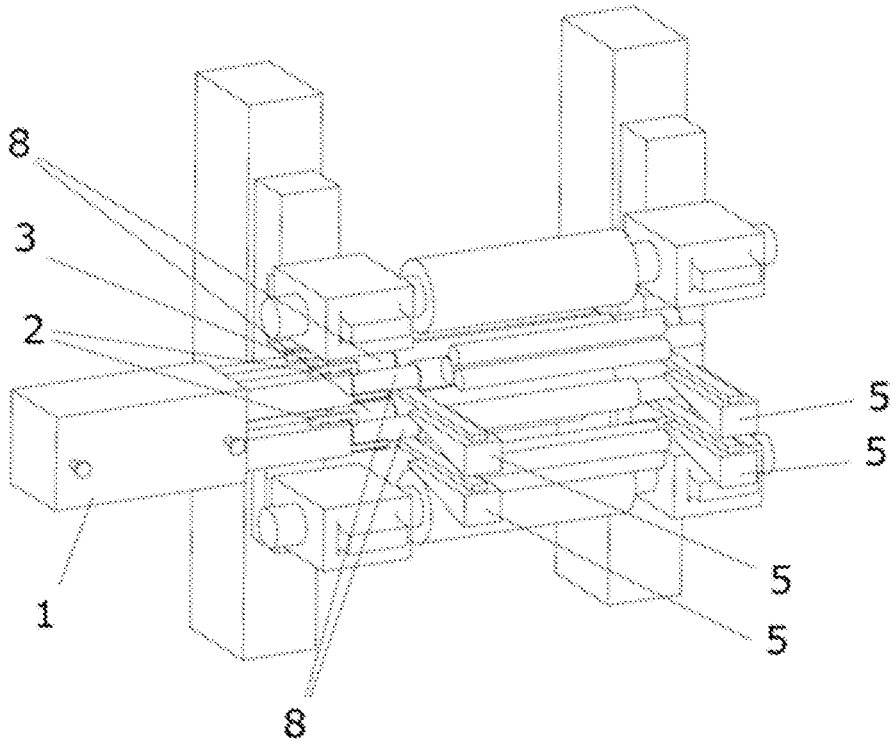
FIG. 9 is a state diagram of changing of work rolls of a mill implemented according to an efficient work roll changing method of the present invention (a roll changing device is in a mill house)
Figure 10:
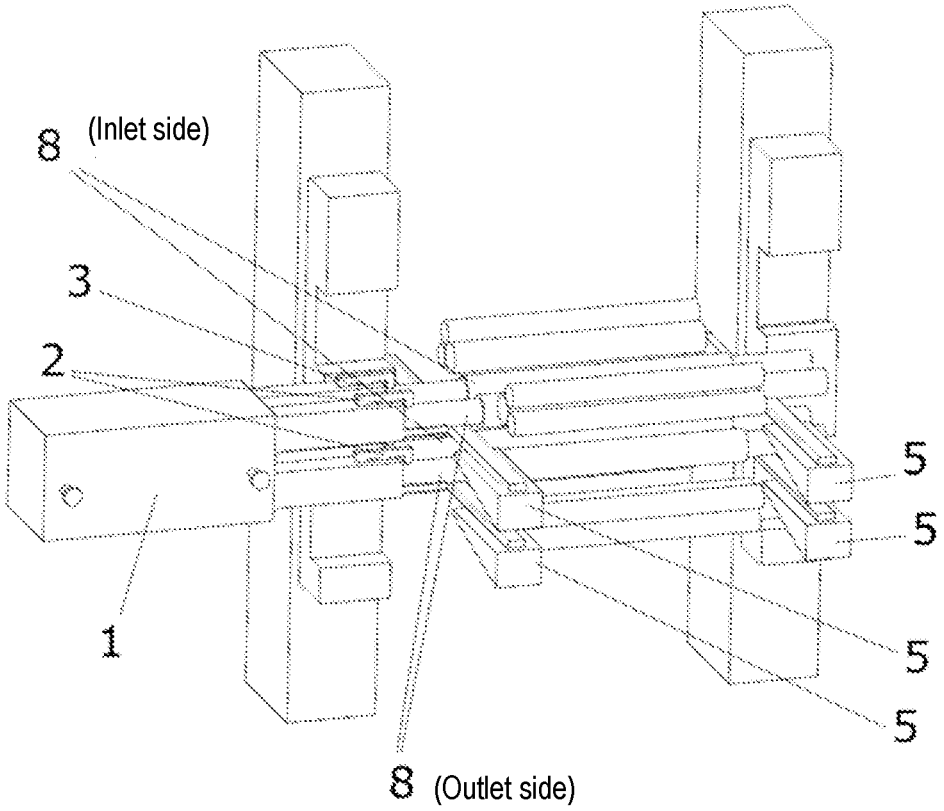
FIG. 10 is a partial schematic diagram (intermediate rolls are omitted) of a state diagram of changing of work rolls of a mill implemented according to an efficient work roll changing method of the present invention (a roll changing device is in a mill house)

(4) Work roll brackets 5 at an outlet side hold up the new work rolls 8, as shown in FIG. 9 and FIG. 10.

(5) The inlet clamping heads 3 of the roll changing device 1 clamp the pair of used work rolls 8 close to the inlet side, as shown in FIG. 9 and FIG. 10.

(6) The work roll brackets 4 at the inlet side retract to a rolling state (the pair of used work rolls 8 at the inlet side are fixed only by the inlet clamping heads 3 of the roll changing device 1 at the moment), and meanwhile, the work roll brackets 5 at the outlet side hold up the pair of new work rolls 8 just pushed in from the outlet side and stay still.

(7) The outlet clamping heads 2 unclamp the pair of new work rolls 8 located at the outlet side (the new work rolls 8 are held up only by the work roll brackets 5 at the outlet side at the moment).

Figure 11:
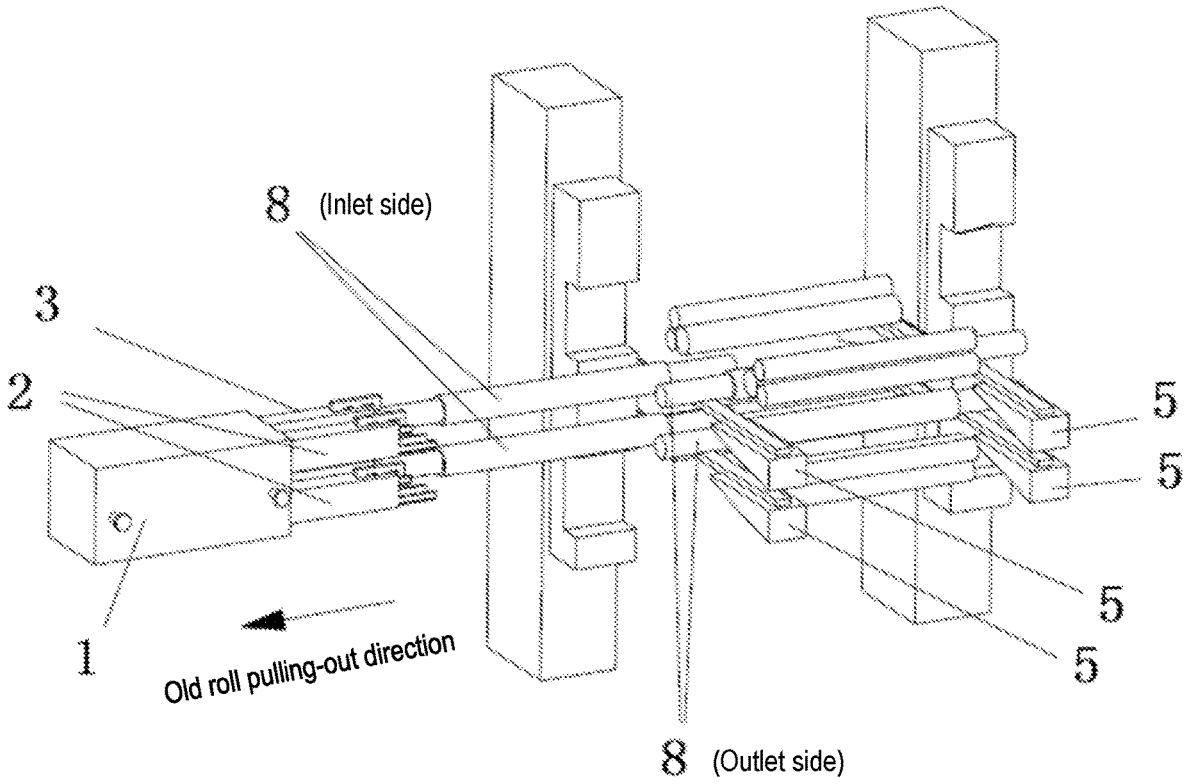
FIG. 11 is a state diagram of changing of work rolls of a mill implemented according to an efficient work roll changing method of the present invention (intermediate rolls are omitted when used rolls are pulled out).

(8) As show in FIG. 11, the roll changing device 1 exits from the mill house, with the inlet clamping heads 3 loading the pair of used work rolls 8, and the outlet clamping heads 2 being in an empty carriage state.

Figure 1:
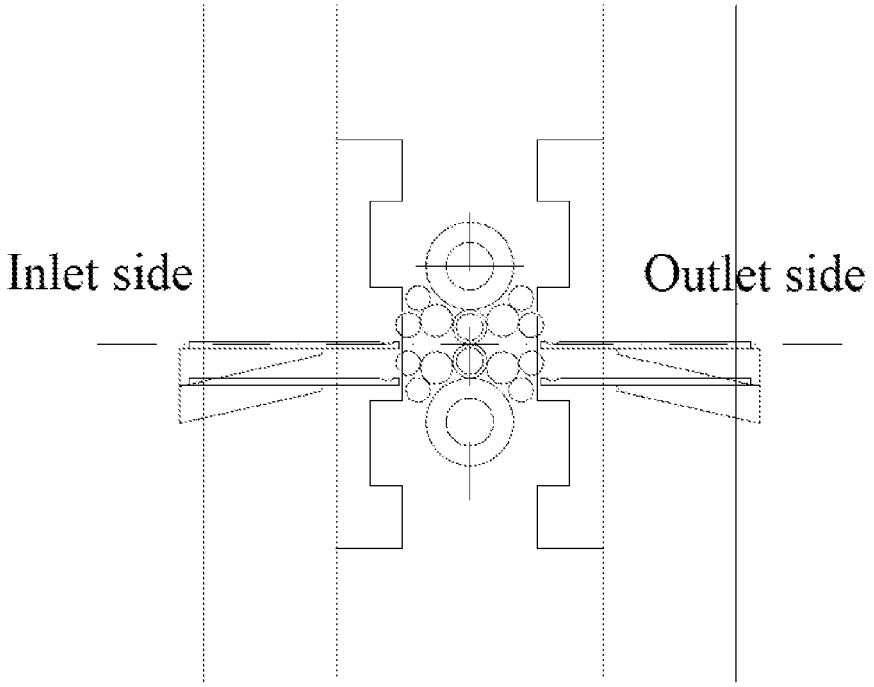
FIG. 1 (PRIOR ART)
FIG. 1 is a rolling state diagram of a multi-roll mill in the prior art.
Figure 2:
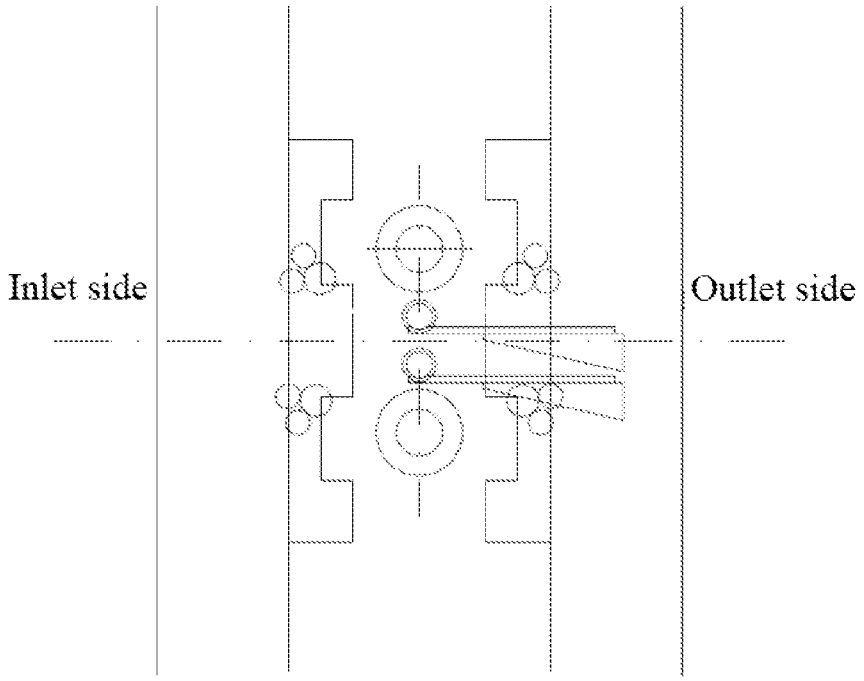
FIG. 2 (PRIOR ART)
FIG. 2 is a work roll changing preparation state diagram of FIG. 1.
Figure 3:
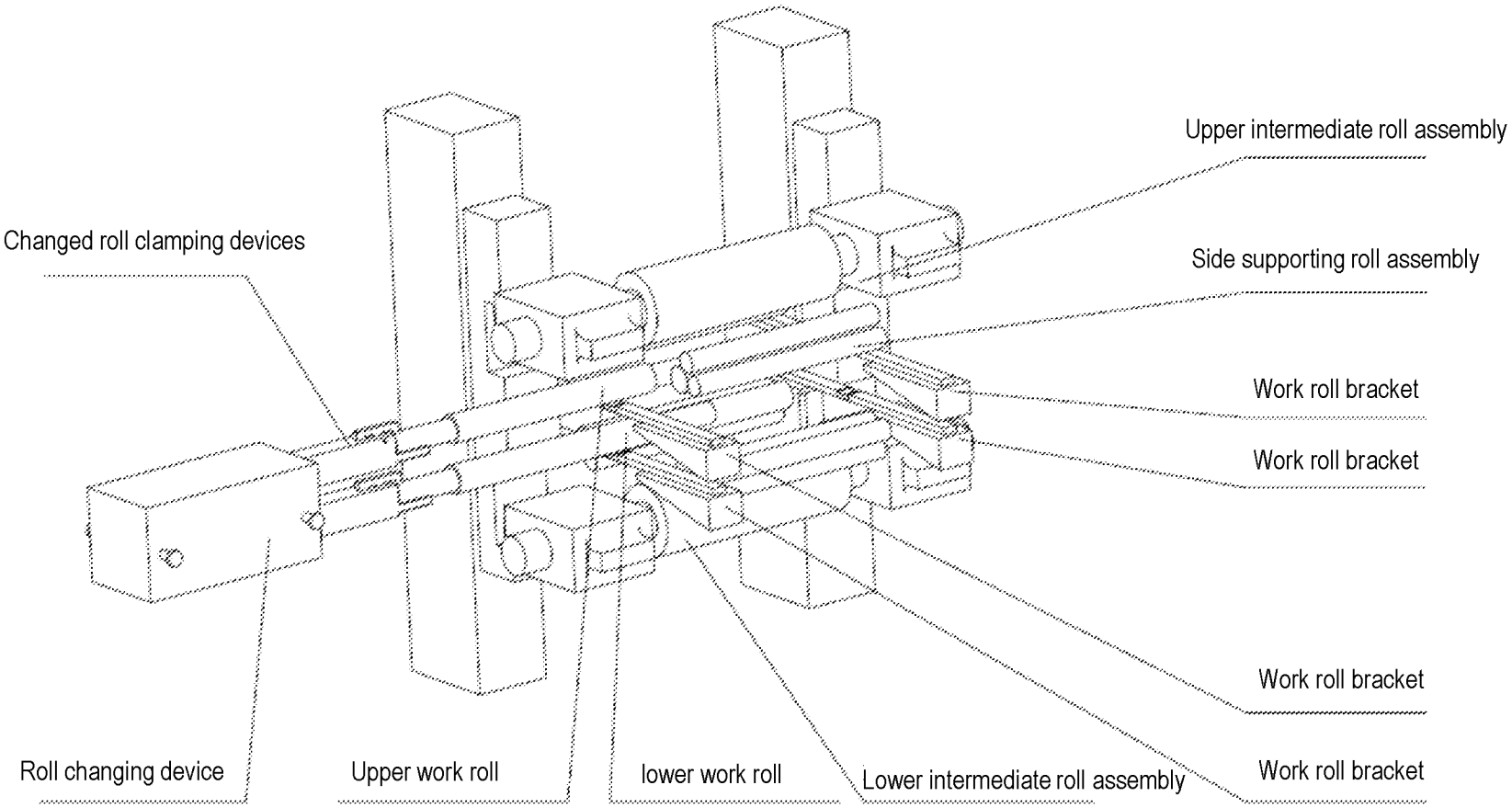
FIG. 3 (PRIOR ART)
FIG. 3 is a work roll changing state diagram (a roll changing device is outside a mill house) of FIG. 1.
Figure 4:
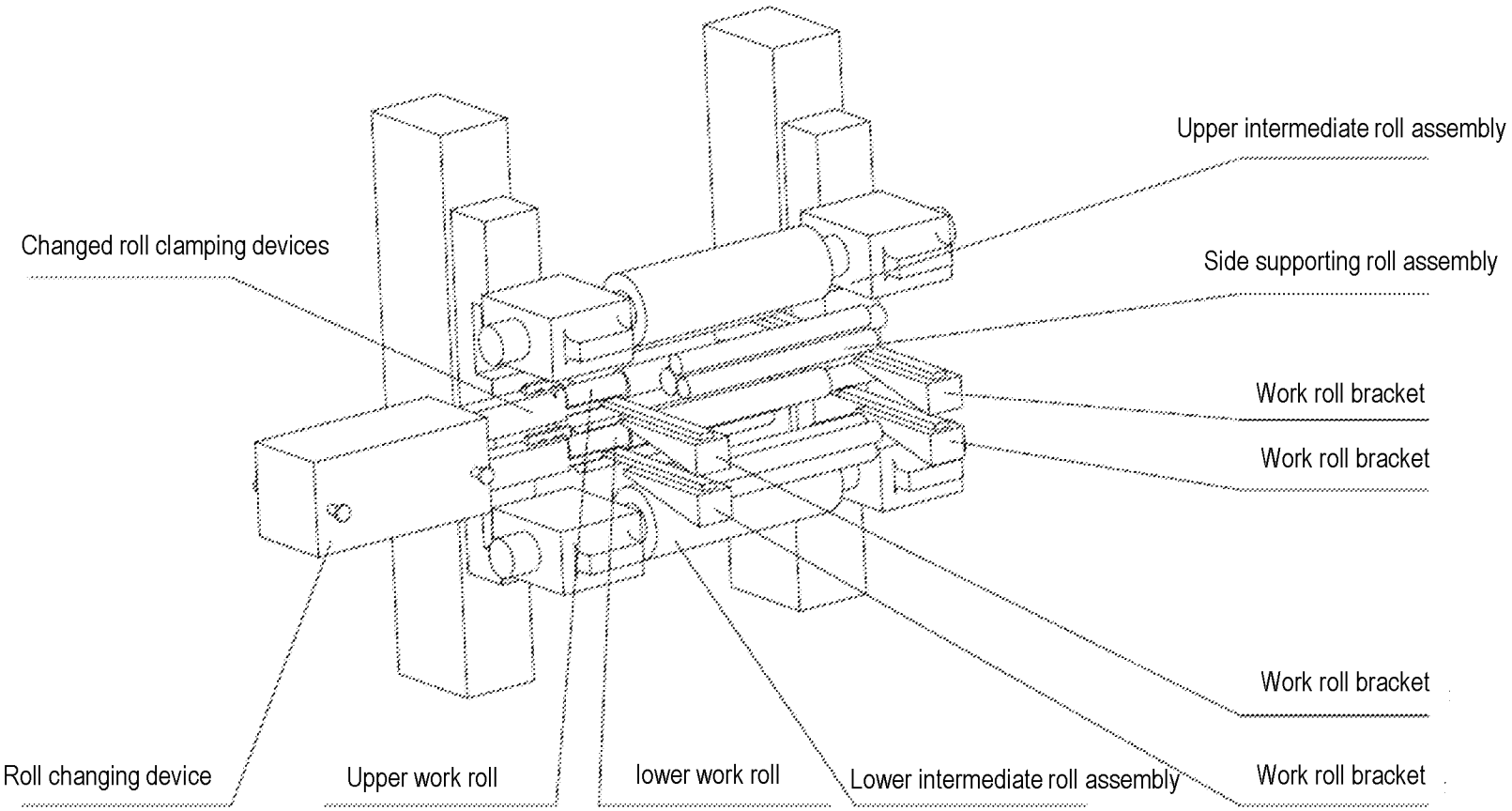
FIG. 4 (PRIOR ART)
FIG. 4 is a work roll changing state diagram (a roll changing device is in a mill house) of FIG. 1.

(9) The mill switches to the rolling state (referring to a rolling state of a general mill in FIG. 1), the roll gap is closed, the work roll brackets 5 at the outlet side retract to the rolling state, and roll changing is completed.

Compared with traditional roll changing methods, the efficient work roll changing method of the present invention has the advantages that operation times of the roll changing device are reduced, the roll changing time can be shortened by 30-60%, especially for wide strip steel mills with the longer movement distance of the roll changing device entering and exiting from the mill house, the roll changing time is significantly shortened by using the method of the present invention, and the operability of the mill is improved.

What is claimed is:

1. A work roll changing method adopting a roll changing device for a multi-roll mill, wherein the multi-roll mill includes a pair of work rolls, a plurality of first work roll brackets, and second work roll brackets, the first work roll brackets and the second work roll brackets are respectively disposed at an inlet side and an outlet side of the mill, and are opposite to each other in a lateral direction, each of the work rolls are not provided with bearing chocks, or the work rolls are provided with bearing chocks, assembly parts of the work rolls and the bearing chocks have a lateral movement space with an internal width no less than an assembly width of the work rolls and the bearing chocks in the lateral direction along a rolling strip in a mill house in a roll changing state, the lateral direction is perpendicular to an axial direction of the work rolls, and the roll changing device is adapted to enter the mill house of the multi-roll mill and replace the work rolls with new work rolls, the roll changing device comprising a main body and at least two rows of clamping heads disposed on a same surface of the main body and arranged in the lateral direction, one of the rows of clamping heads are configured as inlet clamping heads, another one of the rows of clamping heads are configured as outlet clamping heads, each row of clamping heads comprises a pair of upper and lower clamping heads which are arranged in parallel, each upper and lower clamping heads comprises a bottom bracket groove and a clamper arranged on an upper portion of the bottom bracket groove at an interval, the clamper is capable of applying an acting force to a direction of the bottom bracket groove, and the upper and lower clamping heads are adapted to independently clamp and drive a corresponding one of the work rolls to move along the axial direction, wherein the roll changing device changes a pair of used work rolls by entering and exiting the mill house of the multi-roll mill only once, and the work roll changing method comprising the following steps:

(1) switching the multi-roll mill to the roll changing state, opening a roll gap, and holding up the pair of used work rolls by the first work roll brackets of the multi-roll mill, while laterally moving the pair of used work rolls towards the inlet side of the mill by the first work roll brackets;

(2) loading a pair of new work rolls by the outlet clamping heads of the roll changing device, and enabling the inlet clamping heads to be empty;

(3) enabling the roll changing device to enter the mill house along the axial direction of the work rolls, wherein the new work rolls loaded by the outlet clamping heads are adjacent to the second work roll brackets;

(4) holding up the new work rolls by the second work roll brackets;

(5) clamping the pair of used work rolls by the inlet clamping heads of the roll changing device;

(6) enabling the first work roll brackets to retract to a rolling state, wherein the pair of used work rolls is fixed only by the inlet clamping heads of the roll changing device;

(7) unclamping the pair of new work rolls by the outlet clamping heads of the roll changing device, and holding up the new work rolls only by the second work roll brackets;

(8) enabling the roll changing device to exit from the mill house, wherein the pair of used work rolls is loaded by the inlet clamping heads of the roll changing device, and the outlet clamping heads are empty; and (9) switching the mill to the rolling state, closing the roll gap, and enabling the second work roll brackets to retract to the rolling state, and ending roll changing.

2. The work roll changing method according to claim 1, wherein each row of clamping heads can only clamp a single work roll.

3. The work roll changing method according to claim 1, wherein when the new work rolls enter the mill house to be in position and before the used work rolls are pulled out of the mill house, the new work rolls and the used work rolls coexist in the mill house, and the new work rolls are not in contact with the used work rolls.

4. The work roll changing method according to claim 1, wherein the roll changing device loads the new work rolls to be changed before entering the mill house for roll changing.

* * * * *